US005169362A

United States Patent [19]

Schwartz

[11] Patent Number: 5,169,362

[45] Date of Patent: * Dec. 8, 1992

[54] STRENGTH-AEROBIC EXERCISE METHOD

[76] Inventor: Leonard Schwartz, 5526 Northumberland St., Pittsburgh, Pa. 15217

[ * ] Notice: The portion of the term of this patent subsequent to Jun. 12, 2007 has been disclaimed.

[21] Appl. No.: 791,034

[22] Filed: Nov. 12, 1991

Related U.S. Application Data

[63] Continuation-in-part of Ser. No. 579,095, Sep. 5, 1990, abandoned.

[51] Int. Cl.[5] ..... A63B 3/00; A63B 21/068

[52] U.S. Cl. ..... 482/96; 482/42

[58] Field of Search ..... 272/93, DIG. 9, 62, 272/120, DIG. 4, 63, 144, 134; 297/516; 482/38, 41, 42, 95, 96, 141, 148

[56] References Cited

U.S. PATENT DOCUMENTS

| | | | |
|---|---|---|---|
| 2,666,640 | 1/1954 | Jennings | 272/93 |
| 4,336,933 | 6/1982 | Appelbaum | 272/DIG. 9 |
| 4,927,138 | 5/1990 | Ferrari | 272/93 |
| 4,932,653 | 6/1990 | Schwartz et al. | 272/93 |

*Primary Examiner*—Stephen R. Crow
*Attorney, Agent, or Firm*—Ansel M. Schwartz

[57] ABSTRACT

The present invention is a method of exercising which includes the step of addressing an exercise apparatus having a first horizontal member having a free end, a second horizontal member having a free end, a horizontal cross member disposed anteriorly to and above the first and second members and essentially perpendicular thereto and a freestanding platform disposed on a floor for supporting the members in spatial relationship to each other. The platform has a first vertical axis which extends through a first location where the first horizontal members is supported such that it can freely rotate about the first vertical axis and a second vertical axis which extends through a second location where the second horizontal member is supported such that it can freely rotate about the second vertical axis. The platform also defines an open region between the first and second members and below the cross member. Then, there is the step of performing a first exercise while gripping the first and second horizontal members such that at least a portion of the exerciser's body weight is supported by the exerciser's arms and the first and second horizontal members are essentially in a first spaced relationship. Next, there is the step of performing immediately a second exercise while gripping the first and second members such that at least a portion of the exerciser's body weight is supported by the exerciser's arms.

7 Claims, 1 Drawing Sheet

STRENGTH-AEROBIC EXERCISE METHOD

This is a continuation-in-part of copending application(s) Ser. No. 07/579,095, filed on Sept. 5, 1990, now abandoned.

FIELD OF THE INVENTION

The present invention relates to exercise. More specifically, the present invention relates to a method of exercise that couples the development of strength and aerobic capacity throughout the human body.

BACKGROUND OF THE INVENTION

In the prior art of exercise, a great emphasis was placed upon endurance and aerobics as the basis of "good" training. Thus, exercisers strove to achieve appropriate "target" heart rates during relatively prolonged sessions of rhythmic movement (20 to 60 or more continuous minutes).

It is also known in the art of exercise to emphasize strength training. Strength training as it is traditionally performed (low number of repetitions with heavy weights) tends to cause the muscle fibers involved to enlarge (hypertrophy). There is little beneficial effect upon the cardiovascular system. Indeed, it is thought by many that a preponderance of such training may produce certain adverse effects upon the heart itself as well as untoward effects upon the arterial blood pressure.

Efforts to increase the number of repetitions and to make weight training methods more continuous, etc., by having the exerciser move swiftly from one "station" to the next with only short pauses, have also failed to produce significant benefits with respect to endurance (aerobic) capacity. Thus subjects trained by the so-called "circuit" method, while achieving relatively high heart rates during the exercise, have not, generally speaking, increased their oxygen uptake capacity (work capacity) significantly over extended training periods.

These facts provoke the question as to whether or not strength oriented physical training methods can work toward the improvement of the cardiovascular system. This improvement would include such elements as slowing of the heart rate both at rest and at any greater workloads, usually lowering of the systemic blood pressure, along with various enzymatic and other metabolic changes that are readily measurable.

The crucial flaw in methods that attempt to couple strength and aerobic capacity may be their general failure to employ sufficient muscle mass during given exercises. Thus strength training methods typically work one or a few muscle groups at a time. The high heart rates achieved under those conditions do not represent the same physiologic events that general high heart rates during continuous (aerobic) exercise (jogging, brisk walking, swimming, rowing, bicycling) that employ a relatively large percentage of the body's muscle simultaneously provide.

One such method which has met with much greater success in achieving the development of strength and aerobic capacity concurrently uses the idea of converting a pair of individual dumbbells to specially designed hand weights. U.S. Pat. Nos. 4,351,526; 4,627,618 by L. Schwartz teach the development of strength during aerobic exercise by utilizing hand weights during bipedal movements such as jogging. The preferred method of exercising with the hand weights disclosed in the two patents to L. Schwartz is described in the publications entitled Heavyhands: The Ultimate Exercise and HeavyHands Walking, by Leonard Schwartz, M.D. published in 1982 and 1987, respectively. While these patents disclose methods which also are capable of coupling the development of strength and aerobic capacity, they are somewhat limited to work performed by the free motion of the legs and arms during locomotion.

Accordingly, there is usefulness for an exercise method that permits physical training of the body simultaneously for strength and aerobic capacity and which can be applied to all muscle groups of the body while remaining in one location and using body weight as the only resistance required. The entire bodyweight is ideally suited to serve as the resistance for strength-endurance training. This method is designed to allow for the simultaneous action of a great muscle mass in lifting the body repeatedly and over relatively prolonged periods of time. This combined work, which includes a large strength component, cannot be accomplished by any combination of muscle groups activated in sequence. The method lends itself to the careful design of combined movements and to the improvisation of such combined movements.

SUMMARY OF THE INVENTION

The present invention is related to a method of exercising which uses both the arms and legs to perform sustained aerobic and strength conditioning movements. The method includes the step of addressing an exercise apparatus having a first horizontal member having a free end, a second horizontal member having a free end, a horizontal cross member disposed anteriorly above to the first and second members and essentially perpendicular thereto and a freestanding platform disposed on a floor for supporting the members in spatial relationship to each other. The platform has a first vertical axis which extends through a first location where the first horizontal member is supported such that it can freely rotate about the first vertical axis and a second vertical axis which extends through a second location where the second horizontal member is supported such that it can freely rotate about the second vertical axis. The platform also defines an open region between the first and second members and below the cross member. Then, there is the step of performing a first exercise with the exercise apparatus by the exerciser gripping the first and second horizontal members in proximity to their free ends such that at least a portion of the exerciser's body weight is supported by the exerciser's arms and the first and second horizontal members are essentially in a first spaced relationship. Next, there is the step of performing immediately a second exercise with the exercise apparatus by the exerciser gripping the first and second members such that at least a portion of the exerciser's body weight is supported by the exerciser's arms and the first and second members are essentially in a second spaced relationship due to each horizontal member having rotatated about its respective axis.

In an alternative embodiment, the present invention is related to a method of exercising which uses both the arms and legs to perform sustained aerobic and strength conditioning movements. The method includes the step of addressing an exercise apparatus having a first horizontal member having a free end, a second horizontal member having a free end, a horizontal cross member disposed anteriorly to the first and second members and essentially perpendicular thereto and a freestanding platform disposed on a floor for supporting the members in spatial relationship to each other. The platform has a first vertical axis which extends through a first location where the first horizontal members is supported and a second vertical axis which extends through a second location where the second horizontal member is disposed, the platform also defines an open region between the first and second members and below the cross member. Then, there is the step of performing a first exercise with the exercise apparatus by the exerciser gripping the first and second horizontal members such that at least a portion of the exerciser's body weight is supported by the exerciser's arms and the first and second horizontal members are essentially in a first spaced relationship. Then, there is the step of performing immediately a second exercise, with the exercise apparatus by the exerciser pulling the horizontal cross member from below it such that the exerciser's arms primarily support the exerciser's body weight in an unobstructed manner and at least a portion of the exerciser's body weight is supported by the exerciser's legs.

The rhythmic bipedal movements can include jogging scissor kicking forwards or sideways, or alternate leg lifting (to name but a few). The alternate leg lifting can include dipping on a stationary leg, kicking forward, backward or sideways, high knee kicking. Preferably, the exercising apparatus has means to adjust the respective height of the member.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
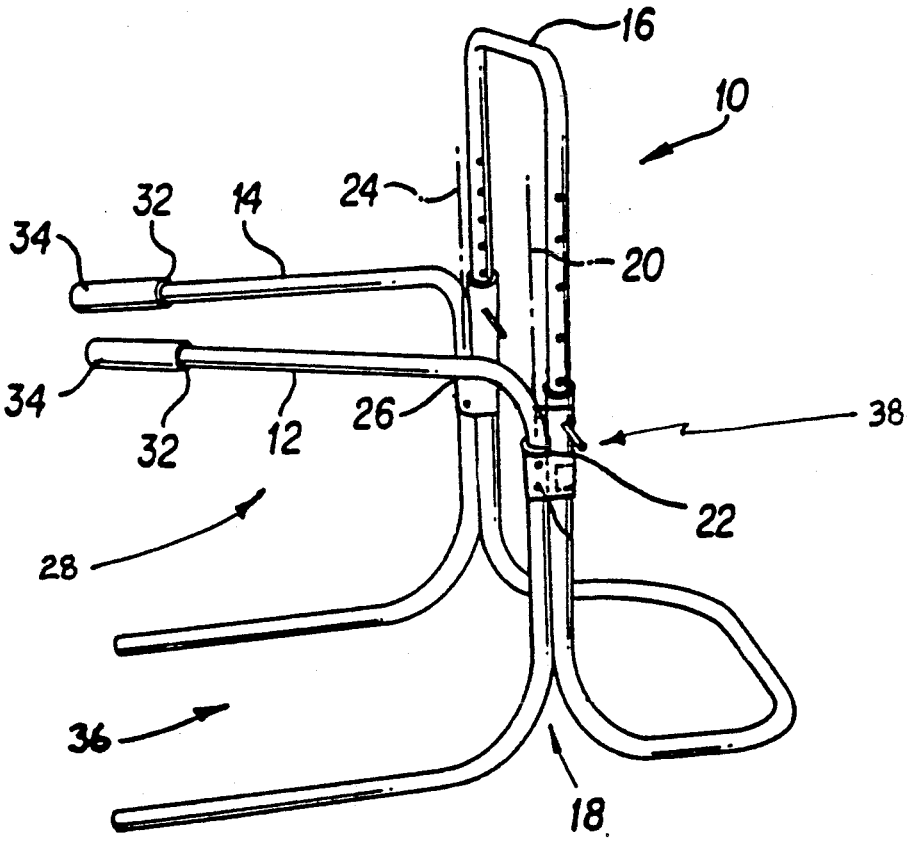
FIG. 1 is a schematic representation of the exercise apparatus on which the described exercise methods are performed.

The present invention is a method of exercising which uses both the arms and legs to perform sustained aerobic and strength conditioning movements. The method comprises the steps of addressing an exercise apparatus comprising a first horizontal member 12 having a free end 32, a second horizontal member 14 having a free end 32, a horizontal cross member 16 disposed anteriorly to the first and second members and essentially perpendicular thereto and a platform 18 disposed on a floor 36 for supporting the members 12, 14, 16 in spatial relationship to each other. The platform 18 has a first vertical axis 20 which extends through a first location 22 where the first horizontal member 12 is supported and a second vertical axis 24 which extends through a second location 26 where the second horizontal member 14 is disposed. The platform 18 defines an open region 28 between the first and second members 12, 14 and below the cross member 16. Preferably, the free ends 32 have handles 34 to aid in gripping the first and second members 12, 14 during exercise.

Then, there is the step of performing a first exercise with the exercise apparatus by the exerciser gripping the first and second horizontal members such that at least a portion of the exerciser's body weight is supported by the exerciser's arms and the first and second horizontal members are essentially in a first spaced relationship. Next, there is the step of performing immediately a second exercise with the exercise apparatus by the exerciser gripping the first and second members such that at least a portion of the exerciser's body weight is supported by the exerciser's arms and the first and second members are essentially in a second spaced relationship.

In an alternative embodiment, the present invention is related to a method of exercising which uses both the arms and legs to perform sustained aerobic and strength conditioning movements. The method includes the step of addressing an exercise apparatus having a first horizontal member having a free end, a second horizontal member having a free end, a horizontal cross member disposed anteriorly to the first and second members and essentially perpendicular thereto and a freestanding platform disposed on a floor for supporting the members in spatial relationship to each other. The platform has a first vertical axis which extends through a first location where the first horizontal members is supported and a second vertical axis which extends through a second location where the second horizontal member is disposed, the platform also defines an open region between the first and second members and below the cross member. Then, there is the step of performing a first exercise with the exercise apparatus by the exerciser gripping the first and second horizontal members such that at least a portion of the exerciser's body weight is supported by the exerciser's arms and the first and second horizontal members are essentially in a first spaced relationship. Then, there is the step of performing immediately a second exercise with the exercise apparatus by the exerciser gripping the horizontal cross member.

In a preferred embodiment, the rhythmic bipedal movements includes jogging. The rhythmic bipedal movements can also include scissor kicking in a forward/backward direction or in a sideways direction. Alternatively, the rhythmic bipedal movements includes alternate leg lifting. Preferably, during alternate leg lifting, the user dips on his stationary leg. Leg lifting can include kicking in the forward direction or kicking in the backward direction. In a preferred embodiment, forward kicking includes the step of high knee kicking. Alternatively, alternate leg lifting can be performed to the side. In another preferred embodiment, the rythmatic bipedal movements includes the step of leaning from side to side. Preferably, the exercise apparatus includes means 38 to adjust the respective heights of the members 12, 14, 16.

The present invention is related to a method of exercising which uses both the arms and legs to perform sustained aerobic and strength conditioning movements. The method includes the step of addressing an exercise apparatus having a first horizontal member having a free end, a second horizontal member having a free end, a horizontal cross member disposed anteriorly to the first and second members and essentially perpendicular thereto and a freestanding platform disposed on a floor for supporting the members in spatial relationship to each other. The platform has a first vertical axis which extends through a first location where the first horizontal members is supported and a second vertical axis which extends through a second location where the second horizontal member is disposed, the platform also defines an open region between the first and second members and below the cross member. Then, there is the step of performing a first exercise with the exercise apparatus by the exerciser gripping the first and second horizontal members such that at least a portion of the exerciser's body weight is supported by the exerciser's arms and the first and second horizontal members are essentially in a first spaced relationship. Next, there is the step of performing immediately a second exercise with the exercise apparatus by the exerciser gripping the first and second members such that at least a portion of the exerciser's body weight is supported by the exerciser's arms and the first and second members are essentially in a second spaced relationship.

In an alternative embodiment, the present invention is related to a method of exercising which uses both the arms and legs to perform sustained aerobic and strength conditioning movements. The method includes the step of addressing an exercise apparatus having a first horizontal member having a free end, a second horizontal member having a free end, a horizontal cross member disposed anteriorly to the first and second members and essentially perpendicular thereto and a freestanding platform disposed on a floor for supporting the members in spatial relationship to each other. The platform has a first vertical axis which extends through a first location where the first horizontal members is supported and a second vertical axis which extends through a second location where the second horizontal member is disposed, the platform also defines an open region between the first and second members and below the cross member. Then, there is the step of performing a first exercise with the exercise apparatus by the exerciser gripping the first and second horizontal members such that at least a portion of the exerciser's body weight is supported by the exerciser's arms and the first and second horizontal members are essentially in a first spaced relationship. Next, there is the step of performing immediately a second exercise with the exercise apparatus by the exerciser gripping the first and second members such that at least a portion of the exerciser's body weight is supported by the exerciser's arms and the first and second members are essentially in a second spaced relationship. Then, there is the step of performing immediately a second exercise with the exercise apparatus by the exerciser gripping the horizontal cross member.

In an alternative embodiment, the method of exercising which uses both the arms and legs to perform sustained aerobic and strength conditioning movements comprises the step of providing an exercise apparatus 10 as described previously and as shown in FIG. 1. Then, there is the step of performing a set of rythmatic bipedal movements in the open region 28 while the arms grip the first and second members 12, 14 such that the arms pull upwardly thereby loading the legs during said movements. This upwards pull is a user controllable load upon the legs during the rythmatic bipedal movements. Next, there is the step of reaching upwards with the arms to grasp the cross member such that the user remains in the open region. Finally, there is the step of performing a set of pull-ups on the cross member while the legs are in contact with the floor such that they assist the arms in lifting the user during pull-ups. In this method, the user pulls down while performing the rythmatic bipedal movements, thereby increasing the load on the legs. Please note that this is in contrast to the previously described method wherein the user supports his body, thereby decreasing the load on the body during the rythmatic bipedal movements. In both methods, the upper body is stressed simultaneously with the lower body such that a large amount of muscle mass is used during sustained exercise movements. This provides for the development of strength and aerobic capacity throughout the user's body.

As with the previously described method, the rythmatic bipedal movements can include jogging, scissor kicking forward/backward or sideways, or alternate leg lifting. The alternate leg lifting can include dipping on the stationary leg, kicking forward, kicking backward, kicking to the side or high knee kicking. Furthermore, the raised legs may be held in position statically (isometric strengthening) while the user hops repeatedly for aerobic benefit (defined as isotonometrics).

The methods described are not limited to these few disclosed movements. There is nearly an infinite number of rythmatic bipedal movements that can be performed on the simple and uncomplicated exercising apparatus 10, while the user shares the load, either positively or negatively, with the arms.

When exercising on the apparatus 10, the upper torso becomes participant in the act of weight bearing through inclusion by the user of his arms in relation to the first and second horizontal members 12, 14; a task obviously left to the lower extremities in usual bipedal life. The arms share or contribute to the load during the various exercise movements. By varying the height of the various members, the exercises can be adjusted to the user's need and abilities. An assortment of movements can be performed on the apparatus 10 for which there is no counterpart among conventional exercise equipment.

The disposition of the first and second horizontal members 12, 14 make it possible for the exerciser to work the major extensor masses of the body, i.e., the triceps of the arms and the quadriceps and glutei of the lower extremities. Additionally, use of the first and second horizontal members 12, 14 allow for the rhythmic and forceful inclusion of flexions and extensions of the trunk musculature. Major flexor muscles of the legs and arms may be included as well. The flexors of the upper extremities are best invoked at the cross member. Indeed, many movements involving the first and second horizontal members 12, 14 have been designed which allow for the simultaneous inclusion of all the muscles specified above. Varying the height of and distance between the horizontal members 12, 14 adds an additional element of variety to these movements by altering the forces required in dealing with the body as the primary resistance.

Using the horizontal cross member 16, the nature of the mechanical opportunities alters substantially. The horizontal cross member 16 is also constructed in more elongate "accessories" so that either taller exercisers are accommodated for conventional use, or it can be used while positioned higher than the top of the heads of users of shorter stature. The horizontal cross member 16 movements are well disposed to "work" the flexor muscles of both extremities (biceps, hamstrings), as well as other muscle masses.

Both the first and second members 12, 14 and the horizontal cross member 16 can be used in "whole body" jogging movements in which the upper body is clearly a most active participant. "Press-ups" and "pull-ups" performed by the arms on the first and second members 12, 14 and the cross member 16 respectively add substantial upper torso work to these in-place ambulatory movements. Additional work may be included by lateral movements of the upper body (side-leans) and abduction/adduction movements of the thighs are options at both positions. Thus, the goal of the method is to maximize the "continuous strength" of a growing assessment of skeletal muscle groups, all within the framework of cardiovascular training. The measurable fitness levels achievable by this method cannot be duplicated by any combination of current conventional strategies, regardless of the complexity, size and overall expense of the equipment subserving those strategies. Further, those well trained by virtue of this method will find themselves able to enhance their performance at most conventional exercises and most forms of sport.

The nature of the additional strength made available by training with this method apparatus and its prescribed techniques is likely to be consistent with the development of "new" skeletal muscle mass which is structurally to be distinguished from that resulting from conventional strength training. It is believed that certain microscopic elements, i.e., intercellular capillaries and intracellular mitochondria will increase in number and density in skeletal muscles. In contrast, it is generally agreed that the distribution of such microscopic elements so crucial to continuous rhythmic work capacity are reduces or remain stable during prolonged conventional weight training.

In terms of agility, this method is employed to fuse strength and endurance and also makes for enhanced motor skill consistent with our general definitions of agility. This unique "whole body" mobility continues to improve along with additions of strength and endurance. Dance-like movements, compound movements, shifts between the first and second members and the cross member, and sprints represent a few of the categories of movement choices that both require and add to the quality of agility that can be gained uniquely from this exercise.

In terms of pure strength, this method is apt to gain considerable strength and most of this will be of the continuous or "Longstrength" variety. This does not preclude training for a pure strength which can also be performed within the constraints of this method. Various pull-ups and press-ups during which the body's weight is shared very little make for this option. Pure leg strength may be added in the form of one legged squats performed at the cross member, first using a slight arm assist, gradually utilizing the leg musculature alone. Abdominal strength may be acquired by a number of movements in which the upper body segment is flexed against resistance, or during movements which require the lower body segment to flex upward while the feet are held off the floor, either while working at the first and second members 12, 14 or at the cross member 16. Again, these strength movements can either represent the user's total full strength training or be used as adjuncts to strength training of the conventional sort.

In terms of flexibility, this method makes possible a unique approach to the acquisition and maintenance of flexibility. Given the support of the body at both first and second members 12, 14 and the cross member 16, whole body flexibility can be attained in either the "static" or "dynamic" mode. The hands can control the force which is applied to any of a large series of stretching movements that also eventuate in increased ranges of motion at the joints (an essential ingredient in most definitions of flexibility)

By the use of this method, stretching movements which enhance flexibility may be combined with the acquisition of strength, since during static stretching the arms may be employed to gradually "force" the joints toward greater degrees of flexion, extension, abduction, adduction, etc. In all cases, the use of the first and second members 12, 14 or the cross member 16 is essential in maintaining balance during certain stretching attitudes whether these be of the static or the dynamic type.

During combined movements, high levels of work efficiency may become established and may be maintained so long as exercise continues. The adjustability of the exerciser apparatus 10 facilitates the control of the mechanical "stresses" on particular body parts, by varying the angles through which limbs and trunk act during exercise movements therewith. The height of the horizontal cross member 16, make for infinite variability of combined movements. The methods describe make possible the continuation of beneficial exercise despite certain single or multiple injuries of the body's motor apparatus. This advantage accrues from the inordinate flexibility of the disclosed methods, the diversity of movements, as well as the versatility of the adjustments of the exercise apparatus 10.

The joints of the feet, ankles, knees and hip, or the joints of the lower extremities, are accorded even greater freedom of motion during these exercises and this results in certain corresponding training effects. The role of the upper torso in sharing in the body's support, allows for unique forms of leg action otherwise unavailable to the user. The body thusly supported may remain elevated longer during jumping or hopping movements. This allows sufficient time for leg actions not reproducible when the body's return to earth is influenced irrevocably by the pull of gravity. While the upper torso is retarding the drop to earth, the legs can execute movements which involve muscle groups that are to a great extent neglected during conventional exercise of the aerobic type. The abductor and adductor muscles (which move the thighs away from and back to the midline respectively) as well as the hamstring groups gain especial advantage from the user of the apparatus. At the same time, the arms strengthen and gain work capability from these "eccentric" contractions which retard the body's acceleration.

Other muscle groups benefit uniquely from the described method. The abdominal and low back muscles may be trained for strength-endurance effectively. A variety of flexions and extensions of the spine, as well as a wide range of torsions of the trunk may be performed rhythmically with great effect in the course of training the cardiovascular mechanisms of the body. By simply varying the height of the horizontal cross member 16, one can effectively train a variety of muscle groups. When, for instance, its height is raised, it lies in a position to effectively train the bicep muscles of the arm by merely grasping the horizontal member 16 in the palm-up position during combined body-lifting movements. In this instance, the user's legs are used to complement the first efforts of pulling up. This effort is user controllable and allows the lower body to participate during primarily upper body movements, such as pull-ups.

A variety of movement tempos and ranges of motion are essential to the most beneficial training with the exercise method. Though the body weight may be considered a relatively constant variable, the positive or negative load can be varied substantially, depending on the circumstances. These variations can thus emphasize fluid buoyant motion one moment and strength at another, without neglecting the endurance factors essential to the performance of the continuous work that is known to be beneficial to the cardiovascular system.

Aside from the great strength and endurance that is gained with these methods, the increased range of motion at various joints results in greater suppleness, i.e. flexibility of the body. Many of the described movements were specifically designed to enhance functional capabilities, without neglecting the user's strength-endurance.

The following are some representative examples and descriptions of suitable bipedal and upper body movements:

Alternate Kicks: Alternate kicks at the bar are an important movement because they become a "filler" move early in training. The exerciser can return to it when the going becomes difficult with any other move. It can be an opening exercise because it can be varied so much that it will always be a respectable trainer, even after being in far better shape. Alternate kicks can vary from movements of small amplitude and slow, or be as high as the crossbar and up to 100 kicks or more per minute. In the laboratory, while monitoring the workload by measuring oxygen uptake, an exerciser can manufacture kick routines for any level of fitness, from deconditioned octogenarians. to elite athletic 17 year olds.

Grasping the first member and second member with both hands (overhand grip), alternately kick each leg. How the user feels determines how to modify the movement as one continues; higher or lower; faster or slower. A metronome or music can be used to maintain a preform tempo. Kicking to each two beats, an exerciser will be doing 50 kicks per minute. 50 times each minute an exerciser will be generating a workload about as vigorous as running a 10 minute mile.

The first and second members should be grasped loosely. Few situations call for anything like a tight grip. In some of the rythmatic moves, the user should simply "lay" the hands on the first and second members since much of the arm work is funneled into the requirement for balance. A tight grip while doing intense physical exercise may tend to raise the blood pressure, so it should be avoided. A loose grip also makes for comfort during prolonged workouts.

Side Leans: Side leans bring the trunk into the action. In the advanced form of the move, the user's head should travel to each side so that it is nearly as low (but on the opposite side) as the kicking foot is high. Side leans change the entire dynamic of alternate kicks, bring more of the latissimus and abdominal obliques into the movement.

Squat/Pull-Ups: To perform a squat/pull-up, the user should grasp the cross member with either an underhand or overhand grip (palms facing back or front, respectively), and stand with feet at shoulder width. Then, the user should squat so that his thighs are almost horizontal. Then, pulling upwards to a standing position, consciously sharing the work between the arms and thigh muscles. After a series of squat/pull-ups, one will typically feel a burn. To rid oneself of this discomfort almost immediately, simply start some light and easy alternate kicks. Relief will occur because the alternate kicks allow for better blood flow to the extremities, and the removal of the lactate that accumulates during moves with a higher than typical strength element. Alternate kicks keep the aerobic level up while one gets prepare for other strength dominated movements.

Jogging: Jogging is one of the moves that may be employed as a "filler", that is, during portions of the workout when the exerciser experiences fatigue from the performance of other more difficult movements. Grasp the first and second members lightly in an overhand grip and then begin to jog. Jogging while supporting oneself with the arms is a whole exercise, which happens to include something that remotely resembles what runners do when they call what they doing. But the hang time is different when compared with conventional running. 120 steps/minute can be achieved with the arms supporting the body. This is impossible during an unsupported jog.

Front Kicks and Digs on Stationary Leg: Position the first and second elements at hip height and kick either to the opposite side or straight ahead, dipping on the back stationary leg. Allow the stationary leg to collapse somewhat at the knee, then reverse the whole procedure. The body can become airborne during the switch. Much of the work depends on the height of the kick. This move becomes fairly balletic with practice.

Scissoring: Place one foot forward, one back, while supporting and dipping oneself with the arms. As the arms push up, switch the front-back leg pattern during a kind of hop. Scissoring is a good whole body strengthener that will become a staple with time. The arm work can be varied a great deal by controlling the dip depth. The depth of dips is varied during scissoring and can be varied with respect to tempo and one's condition. Fifty scissor movements per minute is good average tempo.

The following are some 10 minute medleys:

Medley 1

First and second members: 2 minutes-alternate side kicks, with stationary leg dipping (slow).

Cross member: 2 minutes-alternate high kicks (knees bent) with side leans (slow).

Cross member: 2-minutes-jogs with kick backs and side leans (moderate)

First and second members: 2 minutes-body flexes, push-downs, alternate side leg raises Cross member: 2-minutes-squat/pull-ups Medley 2

Cross member: 3 minutes-alternate karate kicks with body twists and extreme side-back leans (elbow extended on side of kick)

Cross member: 2-minutes-hopping

First and second members: 2 minutes-slow jogs (with body flexes, kickbacks)

First and second members: 3 minutes-alternate side kicks, back leg dipping

Medley 3

First and second members: 2 minutes; AK&D (alternate kicks with dips on back leg)

First and second members: 2 minutes; jogs, push-ups (1 every 4 steps)

Cross member: 3 minutes; crunch hops

Cross member: 3-minutes; skips in place

Medley 4

First and second members: 2 minutes; AK&D

Cross member: 6 minutes; jogs with kick-backs, side-leans

First and second members: 2 minutes; AK&D

Medley 5

Cross member: 2 minutes; alternate knee lifts

First and second members: 2 minutes; body flexes and body extensions

First and second members: 2 minutes; lateral leg raises

Cross member: 2 minutes; hopping with side leans

Cross member: 2 minutes; back, side leans with alternate hi-kicks

Medley 6

First and second members: 2 minutes; scissoring

First and second members: 3 minutes; back leg swings

Cross member: 2 minutes; squats

Cross member: 3 minutes; jog/leans

Medley 7

Cross member: 2 minutes; back side leans with alternate kicks

First and second members for arms: 3 minutes; body flexes with hop-straddles

Cross member: 3 minutes; side-lean jogs

Cross member: 2 minutes; hops with side leans

Medley 8

First and second members: 2 minutes; body flexes

Cross member: 2 minutes; squat-pull ups with alternate kicks

Cross member: 2-minutes; back side leans with alternate kicks

First and second members: 2 minutes; alternate forward kicks

Cross member: 2-minutes; kick across hops

Medley 9

First and second members: 2 minutes; body flexes

Cross member: 2 minutes; alternate one hand pull-ups

Cross member: 3-minutes; jogs with side leans

Cross member: 3-minutes; back side leans with alternate kicks

Medley 10

First and second members: 2 minutes; alternate leg-crosses

First and second members: 2 minutes; jogging with push-ups (four step radio)

Cross member: 2 minutes; pull-ups

First and second members: 2 minutes; alternate cross

Cross member: 2 minutes; back side leans with alternate kicks

The design of the apparatus 10 was intended to make it the first all-purpose exercise apparatus that would implement a revolutionary concept in training. The aim was to provide a mix that could not be duplicated by any number of single purpose apparatuses and methods. Here's a partial list of what the method can provide to an exerciser.

Training with closed systems tends to achieve a plateau relatively quickly. Open systems allow for continuing progress along one or many axes. The present invention assures some progress even after many elements seem to have peaked. Increases in Longstrength, for example, may continue after one has reached a maximal capacity for metabolic work (so called V02 max). Or improved skill may be possible long after measurable work capacity has achieved its peak values. Single movement strategies may be more limited with respect to openness, since the movement tends to make rather fixed challenges upon the trainee. The wisdom of cross training may relate to moving beyond these fixed demands. Open systems thus tend to delay the sense of having arrived and simply settling into chorelike maintenance. One would expect more "eclectic exercisers" to become positively addicted to fitness than those who employ single strategies for their exercise.

Dozens of continuous, rhythmic, muscle loading exercises provide a range of challenges for training the cardiorespiratory systems. In the present invention, an exerciser can do, for instance, a series of 4 limb jogs, push them to sprints when the whim moves the exerciser, do 4 limb dances, switch to one of a hundred or more whole body calisthenics that will make one muscle strong and heart strong while dropping more calories (once trained!) than one can any other way.

Cross training has come to mean training by means of three or more sports. The triathlon is perhaps the most popular version of cross training. From its inception, the present invention was intended to cross train an exerciser in an entirely different sense. (1) the movement designs insure muscle loading such that all an exerciser's muscles are involved in some way in the technique, many of them simultaneously. (2) the largest pastiche of "fitness factors" —items like strength, endurance, power, flexibility various skills make the most cogent claim on the ideal of total fitness. Cross training with the present invention means training fundamentals rather than single move strategies.

The present invention can isolate certain desirable movements from sport than practice with the muscle group combinations that are crucial to those movements (regional training). And specific fitness factors that are called upon in a sport can be emphasized during exercising; things like strength, explosive power of one or more limbs, muscle endurance, agility, etc.

The present invention can make an exercise a Longstrength Expert in a few weeks. The present invention actually links the body's aerobic mechanisms with strength training in a new and exciting way. The results are, in fact, a new sort of muscle that is both strength and endurance trained. Longstrength acquired with the present invention makes strength training uniquely able to incinerate extra body fat.

One of the central virtues of the present invention verticality merely means doing highly respectable exercise while standing in place. It means working directly against the pull of gravity, unlike most conventional aerobics which have one traveling horizontally. The present invention allows one to gain more whole body strength and endurance while, for instance, watching one's favorite TV programming. A different kind of strength than one can gain in the weight room, incidentally; the kind that is the best match for the work and recreational requirements of everyday life.

The present invention implements the conventional sort of static and dynamic stretching, and adds the new dimension of whole body strength stretching. With arm, leg and trunk involvement, stretches will actually lose calories (subaerobics), so that even flexibility training will pare an exercise to a new kind of lean muscularity.

Twenty hours of walking weekly will not make one especially leg-strong. The reason is simple enough. Walking simply does not challenge the contractile properties of muscle that are consistent with strength. In a minute or two, given the proper stimulus one can build progressively greater strength into the great muscle mass that makes up the lower extremities. Even prolonged Longstrength moves using the present invention will generate strength that will greatly exceed that gained from many of popular leg dominated conventional exercises (walking, running, treadmill, biking, swimming, cross-country skiing). By the principle of sharing the resistance (weight) which is actually bodyweight, one gradually can become able to manage an exercise with upper torso musculature alone. Many men cannot manage a single pull-up and few women can. That's not a genetically determined deficiency! It is an assumption herein that few persons who can manage 10 or more consecutive pull-ups are strength deficient for 99% of the things they would opt to do. The principle of training to manage one's own bodyweight is quite different from struggling at bench presses and squats to heft bigger and bigger poundage. All the "external" strength one can muster won't make one fundamentally comfortable unless one can manage himself! Conventional strength training omits countless subtle variations on the theme of strength. The present invention corrals these into interesting routines that will make one strong.

Treatment of back problems is a $50 billion industry. The best cure will doubtless prove to be prevention and intelligent exercise will be a large part of that. A slew of exercises from light and lively to super difficult will do all the things for one's back that one hadn't done before one practiced the present invention. For the 90 or so million back sufferers in the U.S., the present invention would be worth dozens of times what users pay for it, if it did nothing else but strengthen the typically weak back, or help mollify painful spasm of back muscles.

It is believed the prolonged exercise session won't survive long as the best way to get fit. Time requirements for good "aerobic" training have been diminishing lately, and probably for good reason. The present invention awaits use even a minute or two at a time. These brief "encounters" can literally work miracles for fitness factors like strength, agility, power, whole body sprints, attention to those well known trouble spots, etc.

While there are dozens of basic moves in the "standard" repertoire of the present invention, there is freedom for an exerciser to create movements that are particularly suited to the exerciser; to locate and exploit one's latent excellences and to fill the real gaps in the movement adventure that's part of one's Lifespace. When it is considered how people vary in gross and subtle physical ways, one from the other, the joy of self discovery is sure to become a major source of pleasure of the present invention.

People live their lives struggling daily with the tug of gravity. The smaller one is and the more muscular, the greater the ease and presumably the pleasure one can take in movement. Without losing a single ounce, the present invention, by its very nature, will make one feel lighter. That comes from the expectable increases in whole body strength—strength in each major muscle group, and combined strength as dozens of these groups act in unison. Beyond that the total average caloric cost of workouts will accelerate the loss of extra subskin fat and make one actually lighter. It is likely that feeling better about oneself be tied into the very physical changes due to movement efficiency.

The present invention is interesting. The exercises and the simple equipment that implements them were designed to avoid one's notions of the shortcomings of conventional exercise.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of exercising by an exerciser comprising the steps of:

addressing an exercise apparatus comprising a first horizontal member having a free end and a second horizontal member having a free end, a horizontal cross-member disposed anteriorly to and above the first and second members and essentially perpendicular thereto and a platform disposed on a floor for rotatably supporting the horizontal members in spatial relationship to each other, said platform having a first vertical axis which extends through a first location where the first horizontal member is supported such that it can freely rotate about the first vertical axis and a second vertical axis which extends through a second location where the second horizontal member is supported such that it can freely rotate about the second vertical axis, said platform also defines an open region between the first and second members and below the cross member;

performing a first exercise with the exercise apparatus by the exerciser while gripping the first and second horizontal members in proximity to their free ends such that at least a portion of the exerciser's body weight is supported by the exerciser s arms and the first and second horizontal members are essentially in a first spaced relationship; and performing immediately a second exercise with the exercise apparatus by the exerciser while gripping the first and second members such that at least a portion of the exerciser's body weight is supported by the exerciser's arms and the first and second members are in a second spaced relationship due to each horizontal member having rotated about its respective axis.

2. A method as described in claim 1 wherein the first and second exercise includes the step of performing a repetitive flexure of the exerciser's legs while the exerciser simultaneously grips the first and second horizontal members.

3. A method as described in claim 2 wherein the first and second exercise includes the step of performing a set of bipedal movements in said open region while simultaneously gripping the first and second members such that arms assist the legs in supporting and mobilizing the user during said movements.

4. A method as described in claim 3 wherein the step of performing a set of bipedal movements includes the step of jogging.

5. A method of exercising by an exerciser comprising the steps of:

addressing an exercise apparatus comprising a first horizontal member having a free end, a second horizontal member having a free end, a horizontal cross member disposed anteriorly and above to the first and second members and essentially perpendicular thereto and a freestanding platform disposed on a floor for supporting the horizontal members in spatial relationships to each other, said platform having a first vertical axis which extends through a first location where the first horizontal member is supported and a second vertical axis which extends through a second location were the second horizontal member is disposed, said platform also defines an open region between the first and second members and below the cross member;

performing a first exercise with this exercise apparatus by the exerciser gripping the first and second horizontal members such that at least a portion of the exerciser's body weight is supported by the exerciser's arms and the first and second horizontal members are essentially in a first spaced relationship; and performing immediately a second exercise with the exercise apparatus by the exerciser pulling against the horizontal cross member from below it such that the exerciser's arms primarily support the exerciser's body weight in an unobstructed manner and at least a portion of the exerciser's body weight is supported by the exerciser's legs.

6. A method as described in claim 5 wherein the step of performing the second exercise including the step of gripping the horizontal cross member while the exerciser's legs are in contact with the floor upon which the apparatus is disposed such that the legs simultaneously assist the arms while performing the second exercise.

7. A method as described in claim 6 wherein the first exercise includes the step of performing a repetitive flexure of the exerciser's legs while the exerciser simultaneously grips the first and second members.

* * * * *